United States Patent [19]

Hagshenas

[11] Patent Number: 4,878,805

[45] Date of Patent: Nov. 7, 1989

[54] BLOWER FOR USE IN PARTICLE CONTAMINATED ENVIRONMENTS

[75] Inventor: Behzad Hagshenas, San Diego, Calif.

[73] Assignee: Sundstrand Corporation, Rockford, Ill.

[21] Appl. No.: 260,036

[22] Filed: Oct. 20, 1988

[51] Int. Cl.[4] ..... F01D 25/32

[52] U.S. Cl. ..... 415/169.1; 415/106; 415/121.2

[58] Field of Search ..... 415/106, 108, 112, 121.2, 415/168.1, 169.1

[56] References Cited

U.S. PATENT DOCUMENTS

| | | | |
|---|---|---|---|
| 1,640,601 | 8/1927 | Delery | 415/106 |
| 3,250,069 | 5/1966 | Rhoda | 415/121.2 |
| 3,256,829 | 6/1966 | Schneider | 415/121.2 |
| 3,264,653 | 8/1966 | Lebkuchner | 415/106 |
| 3,280,750 | 10/1966 | White | 415/169.1 |
| 3,977,811 | 8/1976 | Kuintzle, Jr. | 415/121.2 |
| 4,756,664 | 7/1988 | Cohen et al. | 415/110 |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

An impeller-type blower for use particularly in environments of particle contaminated air includes a housing defining an aft cavity. An impeller, including a shaft, is rotatably mounted in the housing by a bearing forward of the aft cavity. Passages communicate the aft cavity with a region forward of the bearing to provide a pressure balance on opposite sides of the bearing and, thereby, prevent particle contaminants from infiltrating the bearing.

12 Claims, 1 Drawing Sheet

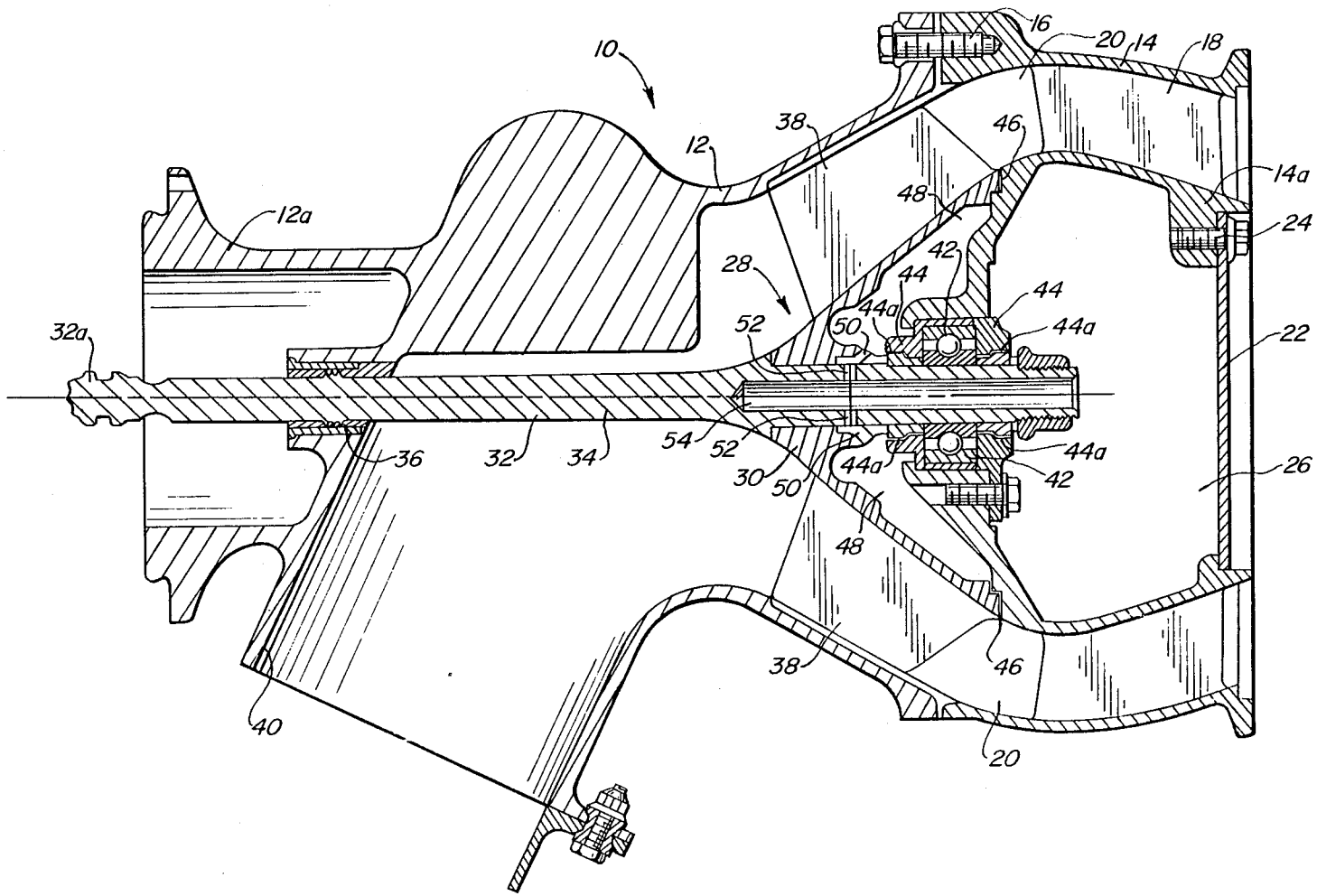
10
12
12a
14
14a
16
18
20
22
24
26
28
30
32
32a
34
36
38
40
42
44
44a
46
48
50
52
54

BLOWER FOR USE IN PARTICLE CONTAMINATED ENVIRONMENTS

FIELD OF THE INVENTION

This invention generally relates to blowers and, particularly, to an impeller-type blower for use particularly in environments of particle contaminated air.

BACKGROUND OF THE INVENTION

Impeller-type air pumps or blowers are used in many environments or applications. Such a blower conventionally includes a housing defining a pumping chamber or cavity within which an impeller assembly is rotated. The impeller assembly is mounted on shaft means rotatably journaled within the housing and including radially projecting blades for drawing air into an inlet of the housing and out through an outlet. Bearings and seals are provided about the impeller shaft to journal the shaft within the housing and to prevent air leakage past the impeller except through its intended flow path.

One environment where blowers are used is in conjunction with a particle separator in environments of particle contamination. For instance, in aircraft applications, such as with helicopters, the vehicles may be used over sandy areas, such as deserts, and particle separators are used to prevent the intake of particle contaminated air from adversely effecting or damaging the engine of the helicopter. Such particle separators use blowers for their operation. A major problem concerns the introduction of particle contaminated air into the bearings of the blower impeller which could result in catastrophic failure of the bearing and, thus, eventual failure of the main engine itself.

This invention is directed to solving the above problem by providing a novel means for pressure balancing opposite sides of bearings in an impeller-type blower to prevent particle contaminants from infiltrating the bearing means and/or seal means.

SUMMARY OF THE INVENTION

An object, therefore, of the invention is to provide improvements in impeller-type blowers for use particularly in environments of particle contaminated air.

In the exemplary embodiment of the invention, a housing is shown to include an aft cavity. Impeller means, including shaft means, are rotatably mounted in the housing means by bearing means forward of the aft cavity. Passage means communicate the aft cavity with a region forward of the bearing means to provide a pressure balance on opposite sides of the bearing means and, thereby, prevent particle contaminants from infiltrating the bearing means.

In the preferred embodiment of the invention, the passage means extend directly through the shaft means between opposite sides of the bearing means and seals.

Generally, the invention contemplates providing passage means communicating between at least a pair of cavities on opposite sides of the bearing means of an impeller blower to provide a pressure balance therebetween and prevent particle contaminants from infiltrating the bearing means.

Other objects, features and advantages of the invention will be apparent from the following detailed description taken in connection with the accompanying drawing.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing, in which like reference numerals identify like elements in the figure and in which the single Figure is an axial section through an impeller-type blower embodying the concepts of the invention.

DETAILED DESCRIPTION OF THE PREFERRED EMBODIMENT

Referring to the drawing in greater detail, the invention is illustrated in a centrifugal, impeller-type blower, generally designated 10. The blower includes a housing having a main housing section 12, and an aft housing section 14 bolted to housing section 12, as at 16. Housing section 12 has a portion **12*a* which, for instance, mounts directly on an engine gear box of a helicopter. Aft housing section 14 includes an interior portion 14*a* with integral radially projecting "deswirling" struts 18 protruding into a surrounding flow path 20. Deswirling struts 18 are generally parallel to the air flow path to "straighten" the air passing through the blower. An aft cap 22 is secured to aft housing section 14 by appropriate fastening means, as at 24, and defines an aft cavity 26**.

Impeller means, generally designated 28, are rotatably mounted within the housing means defined by housing sections 12 and 14. More particularly, the impeller means include a rotatable hub 30 fixed to a shaft 32 whereby the impeller means is rotatable within the housing about an axis 34. A labyrinth seal 36 is provided between shaft 32 and mounting portion **12*a* of housing section 12**.

Impeller blades 38 project radially outwardly from impeller hub 30 into flow path 20. Shaft 32 includes a distal end **32*a* projecting into the gear box (not shown) for rotating the impeller means. Upon rotation of the impeller means, blades 38 are effective to draw air from an inlet 40 in housing section 12** from the inlet of an engine of a particle separator (not shown).

Bearing means 42 are provided about shaft 32 between the shaft and stationary interior portion **14*a* of aft housing section 14. Seal means 44 are provided about bearing means 42 and are formed with stepped labyrinth seal surfaces 44*a*. Impeller hub 30 can be seen to be rotatable adjacent stationary interior portion 14*a* of aft housing section 14. Consequently, a clearance, as at 46, must be provided to allow for this relative rotation. However, clearance 46 allows for high pressure air to migrate into an interior region 48 on one side of bearing means 42 and seal means 44 opposite aft cavity 26. In other words, two cavities 26 and 48 are formed on opposite sides of bearings 42 and seals 44. Although aft cavity 26 is sealed, a pressure imbalance is created upon start-up of the impeller. As a result of this pressure imbalance, air tends to migrate through labyrinth seals 44*a* and past and through bearings 42**. Since the blower is used in environments of particle contamination, particles also migrate through the seals and bearings particularly during blower start-up. As the contaminating particles, such as sand, infiltrate the bearings, the bearings can become damaged and malfunction, resulting in failure of the bearings and a complete breakdown of the blower. This can be catastrophic in actual use on helicopters or like vehicles.

Generally, the invention contemplates establishing a pressure balance between cavities 26 and 48 to prevent particle contaminants from migrating seals 44 and infiltrating bearings 42. More particularly, passages 50 are provided through impeller hub 30 communicating with cavity 48. Passages 52 are provided radially through shaft 32 in communication with passages 50. An axial passage 54 is provided in shaft 32 in communication with radial passages 52. Axial passage 54 is in communication with aft cavity 26. Therefore, passages 50,52 and 54 define passage means establishing communication between cavities 26 and 48 on opposite sides of bearings 42 and seals 44. This passage means is much larger than the stepped clearance 44*a* of labyrinth seals 44. Consequently, a path of least resistance is provided and any particle contaminated air which enters cavity 48 through clearance area 46 will migrate through the passage means, bypassing the bearings, to closed aft cavity 26, resulting in a pressure balance on opposite sides of the bearings and, thereby, prevent particle contaminants from infiltrating the bearings.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An impeller-type blower for use particularly in environments of particle contaminated air, comprising:

housing means defining an aft cavity;

impeller means including shaft means rotatably mounted in the housing means by bearing means forward of the aft cavity for drawing the particle contaminated air from an inlet of housing means; and passage means communicating the aft cavity with a region forward of the bearing means to provide a pressure balance on opposite sides of the bearing means and thereby prevent particle contaminates from infiltrating the bearing means.

2. The blower of claim 1 wherein said passage means extend through the shaft means.

3. The blower of claim 1 wherein seal means are provided about the bearing means, and one end of said passage age means is located near a forward part of the seal means.

4. The blower of claim 3 wherein said passage means extend through the shaft means.

5. In a blower for use particularly in environments of particle contamination, the blower including impeller means rotatably mounted in housing means by bearing means between two cavities on opposite sides of the bearing means for drawing the particle contaminated air from an inlet of housing means, the improvement comprising passage means communicating between said cavities to provide a pressure balance therebetween and thereby prevent particle contaminates from infiltrating the bearing means.

6. In a blower as set forth in claim 5 wherein the impeller means include shaft means, and wherein said passage means pass through the shaft means.

7. In a blower as set forth in claim 6 wherein seal means are provided about the bearing means, and wherein said passage means is located near a part of the seal means.

8. In a blower as set forth in claim 7 wherein the impeller means include shaft means, and wherein said passage means pass through the shaft means.

9. A blower for use particularly in environments of particle contamination, comprising:

housing means;

impeller means rotatably mounted in the housing means by bearing means between two cavities for drawing the particle contaminated air from an inlet of housing means; and passage means communicating between said cavities on opposite sides of the bearing means to provide a pressure balance therebetween and thereby prevent particle contaminates from infiltrating the bearing means.

10. The blower of claim 9 wherein said impeller means include shaft means and said passage means extend through the shaft means.

11. The blower of claim 9 wherein seal means are provided about the bearing means, and one end of said passage means is located near a forward part of the seal means.

12. The blower of claim 11 wherein said impeller means include shaft means and said passage means extend through the shaft means.

* * * * *